United States Patent [19]

Kovaleski et al.

[11] Patent Number: 4,648,765

[45] Date of Patent: Mar. 10, 1987

[54] UNIVERSAL TIE-DOWN BRACKET

[76] Inventors: John W. Kovaleski, Lake Parkway, Webster, Mass. 01570; Thomas M. Lee, Irene St., Douglas, Mass.

[21] Appl. No.: 777,721

[22] Filed: Sep. 19, 1985

[51] Int. Cl.[4] ..... B61D 45/00

[52] U.S. Cl. ..... 410/110; 24/115 K; 248/499; 114/218; 410/106

[58] Field of Search ..... 410/101, 106, 108, 97, 410/110, 30; 24/115 K, 129 C, 138 R, 138 C, 128; 403/206, 207; 248/499, 302, 500, 74.1, 218.1, 218.2; 114/218, 230, 74.1

[56] References Cited

U.S. PATENT DOCUMENTS

| | | | |
|---|---|---|---|
| 2,219,655 | 10/1940 | Markey | 248/74.1 |
| 2,441,336 | 5/1948 | Sova | 410/101 X |
| 3,066,950 | 12/1962 | Olson et al. | 410/106 X |
| 3,323,772 | 6/1967 | Dupree et al. | 248/499 |
| 4,070,834 | 1/1978 | Jameson | 410/101 X |
| 4,398,744 | 8/1983 | Schöppel et al. | 410/106 X |

FOREIGN PATENT DOCUMENTS

| | | | |
|---|---|---|---|
| 1069661 | 11/1959 | Fed. Rep. of Germany | 410/101 |
| 155671 | 5/1952 | U.S.S.R. | 410/30 |

*Primary Examiner*—Robert B. Reeves
*Assistant Examiner*—Glenn B. Foster
*Attorney, Agent, or Firm*—H. Gibner Lehmann; K. Gibner Lehmann

[57] ABSTRACT

A two-piece universal tie-down bracket which has wide applications but is especially useful in connection with utility trucks having plastic bed liners, and with marine craft. The bracket comprises an elongate base member constructed as a wire form, having openings at its ends and an open loop intermediate its ends. The base member is mounted on a supporting surface such as the plastic bed liner by screws, bolts or the like passing through the end openings, and prior to its attachment a tethering ring also fabricated as a wire form is placed in the open loop to hang loosely therefrom in readiness for use after securement of the base member. The supporting surface for the base member holds the tethering loop captive, and the loop will hang in a collapsed out-of-the-way position close to the base member for a large number of different mounting positions of the latter.

11 Claims, 9 Drawing Figures

UNIVERSAL TIE-DOWN BRACKET

BACKGROUND

This invention relates to tie-down brackets as used in connection with rope and lashings, for securing cargo and the like in carry spaces such as vehicle bodies.

Heretofore it has been customary to mount fitments such as hooks or brackets on wall surfaces of truck bodies, boat hulls and various storage areas, to enable ropes to be used for tying down the articles which are to be transported.

The simplest of such fitments is the screw eye or screw hook. Typically these are not suitable for anchorage in sheet metal walls, and under any circumstance they protrude and require space which often is needed for the cargo. Moreover, in many cases they constitute a hazard since their rigidity and protrusion can cause physical injury.

Another fitment that has been previously used comprises a heavy staple or loop as in a hasp, which is carried by a base or mounting plate that is apertured to receive screws for attaching it to a supporting surface. Here, again, the protrusion and rigidity of the staple rendered it undesirable in many situations.

SUMMARY

The above drawbacks and disadvantages of prior tie-down fitments are obviated by the present invention, which has for one object the provision of a novel and improved tie-down bracket which finds universal application in that it is attachable to all manner of surfaces including sheet metal, and does not protrude appreciably into the cargo space.

Another object of the invention is to provide an improved tie-down bracket in accordance with the foregoing, which is especially safe in its use, having no sharp or other points to cause injury to personnel.

Still another object of the invention is to provide an improved tie-down bracket as above set forth, which is especially simple and economical to fabricate.

The above objects are accomplished by the provision of a unique two-piece tie-down bracket the parts of which are constituted as wireforms, one part comprising an elongate base member having intermediate its ends an open loop, and having openings at said ends to receive hold-down screws or the like by means of which it can be mounted on a supporting surface. Cooperable with the wireform base member is a wireform tethering ring which is passed through the open loop of the base member and is adapted to hang loosely therefrom in an out-of-the-way non-protruding position in readiness for use regardless of the base member being mounted in any one of an infinitely large number of positions. The tethering ring constitutes a continuous annulus which is admitted through the opening of said open loop during assembly of the bracket, and is held captive by the supporting surface to which the base member is affixed.

In the accompanying drawings, showing a preferred embodiment of the invention:

Referring to the various figures, the improved and simplified, universally adaptable tie-down bracket is, in its preferred form, constituted as a two-part device fabricated of heavy, round wire stock each part of which can be expeditiously and inexpensively manufactured on typical four-slide forming machines. After forming, the tethering ring part has its abutting ends securely welded together. The parts are cleaned or degreased, and then barrel or tumble plated, preferably with cadmium, and thereafter tumble polished. A simple and quick hand assembly of the ring to the base member is done, this being possible by the unique construction of the base member whereby it has an open loop intermediate its ends.

Figure 1:
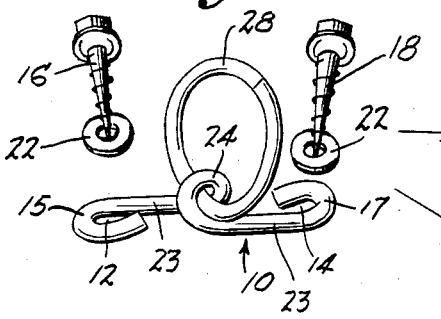
FIG. 1 is a perspective view of the assembled tie-down bracket of the invention, and of two mounting screws and washers therefor, illustrating the mode of attachment to a supporting surface.
Figure 2:
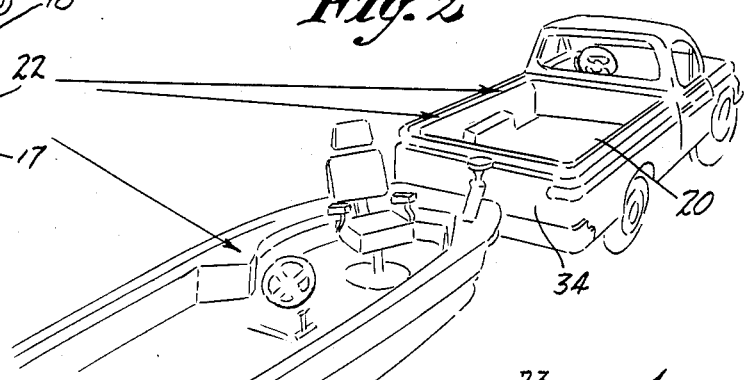
FIG. 2 is a diagrammatic perspective view of a utility truck and boat being hauled thereby, illustrating several possible locations for use of the tie-down bracket of FIG. 1.

As shown, the base member 10 is of elongate configuration and provided with openings 12, 14 at its ends 15, 17 by virtue of oppositely looping the latter, thereby to receive the mounting screws 16, 18 seen in FIG. 1. The screws 16, 18 can be of any type, such as sheet metal or wood screws, or drive screws or drive nails, depending on the nature of the surface with which the bracket is to be used. In conjunction with utility trucks having plastic bed liners such as the bed liner 20 illustrated in FIG. 2, the screws are preferably of the thread-cutting variety known as sheet metal screws. Washers 22 are preferably used under the heads of the screws 16, 18 as seen in FIG. 1, although the use of washers is not essential for the mounting of the base member 10.

Figure 4:
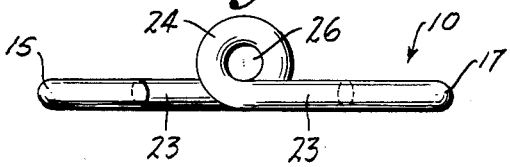
FIG. 4 is a side elevational view of the base member of FIG. 3.

Intermediate its ends, the base member 10 has straight portions 23 and is bent into a one-turn helix 24 to form an open loop designated 26 in FIG. 4, having a spacing 27 between turns which is somewhat greater than the thickness of the tethering ring 28, thereby to enable the latter to be readily assembled to the member 10. The portions 23 lie in parallel planes and are normal to the axis A of the helix 24. The ends 15, 17 and the straight portions 23 all lie in a common plane.

Figure 6:
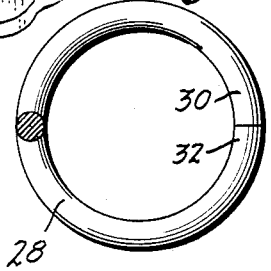
FIG. 6 is a plan view of the tethering ring per se, of the tie-down bracket.

Referring to FIG. 6, the tethering ring of the bracket is seen to have a perfectly circular shape. Its abutting ends 30, 32 are securely welded to make the ring continuous, this being done prior to assembly to the base member.

As stated above, after the wire forming of the two parts has been effected, they are cleaned or degreased, and then barrel plated with cadmium and tumble polished.

Figure 7:
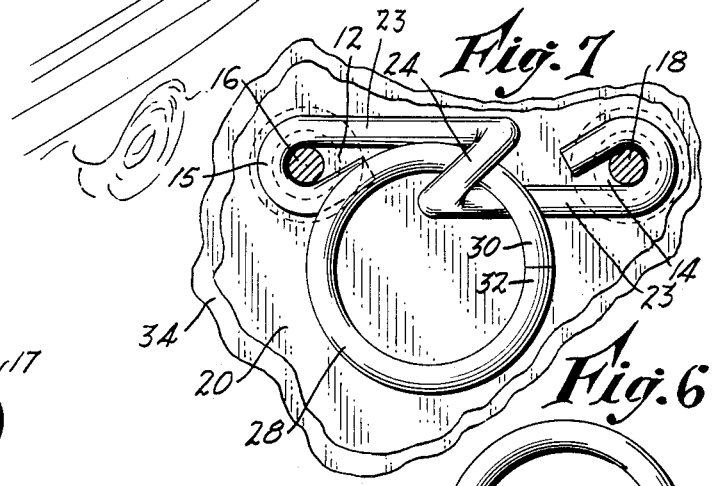
FIG. 7 is an elevational view of the tie-down bracket mounted on the bed-liner of a utility truck. The mounting studs or parts are shown in section, and the bracket extends horizontally with the tethering ring hanging down or laterally of the bracket.
Figure 3:
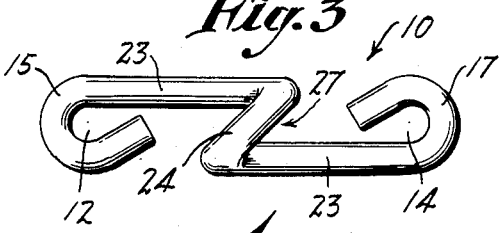
FIG. 3 is a top plan view of the base member of the tie-down bracket, constituted as a wire form.

By virtue of the open or large pitch angle of the one-turn helix 24, the tethering ring 28 can be easily and quickly slipped into the center open loop 26 of the bracket member 10, by hand. When the base member 10 is mounted on a supporting surface such as the bed liner 20 and truck body wall 34 shown in FIG. 7, the tethering ring 28 will be held captive by such surface. In FIG. 7, the supporting surface comprises only a fragmentary showing of the truck body and the plastic bed liner therefor.

Figure 8:
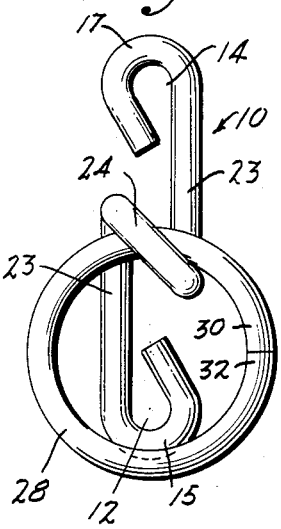
FIG. 8 is an elevational view of the tie-down bracket in a mounting position wherein it extends vertically. This illustrates a differenet storage position of the tethering ring.
Figure 5:
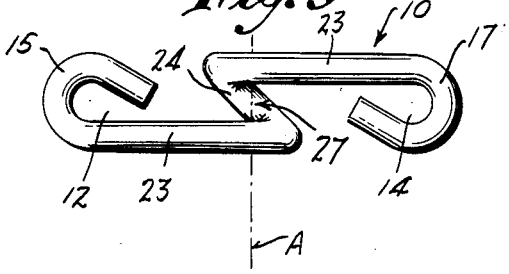
FIG. 5 is a bottom plan view of the base member of FIGS. 3 and 4.
Figure 9:
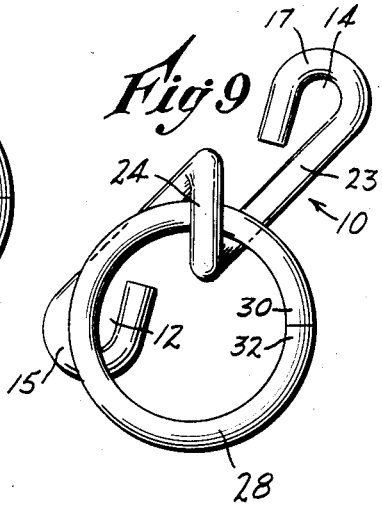
FIG. 9 is an elevational view of the tie-down bracket in an oblique, vertical mounting position, with the tethering ring occupying still another storage or out-of-the-way position.

An important feature of the present tie-down bracket is the ability of the tethering ring 28 to naturally hang in a pendant, out-of-the-way position when not in use, regardless of the position or angle of mounting of the base member 10, as illustrated in FIGS. 7, 8 and 9. The plane of the ring 28 is substantially parallel to that of the supporting surface 20 to which the ends 15, 17 are fastened. This is in sharp contrast to rigid hooks and the like such as were previously used to hold down cargo or other goods, where such hooks were rigid and fixed, and protruded and were inconvenient and sometimes hazardous in use.

It will now be seen that the tie-down bracket of the present invention is especially simple and economical to manufacture, and that it has important advantages in enabling easy installation, safety when in use, and strength and reliability.

Each and every one of the appended claims is to be reviewed on its own merits as an inventive concept separate from the others when considering the prior art devices, and variations and modifications are possible without departing from the spirit of the invention.

What is claimed is:

1. A two-piece universal tie-down bracket comprising, in combination:

(a) an all one piece integral elongate base member having intermediate its ends an open loop, said open loop comprising a single coil of a helix, said base member having openings at said ends to receive hold-down screws by means of which it can be applied to a supporting surface, and (b) a tethering ring passing through the open loop of the base member, said ring being adapted to hang loosely in readiness for use from said open loop for any one of an infinitely large number of positions in which the base member can be fastened, (c) said tethering ring constituting a continuous annulus and being admissible through the opening of said open loop during assembly of the tethering ring to the base member, and said ring being held captive by the supporting surface to which the base member is affixed.

2. A tie-down bracket as set forth in claim 1, wherein:

(a) said base member comprises a wire form.

3. A tie-down bracket as set forth in claim 1, wherein:

(a) said tethering ring comprises a wire form having abutting end portions which are welded to each other.

4. A tie-down bracket as set forth in claim 2, wherein:

(a) the ends of the base member are bent to form a loops providing the said openings.

5. A tie-down bracket as set forth in claim 1, wherein:

(a) the diameter of the tethering ring is equal to approximately one half the length of the base member.

6. A tie-down bracket as set forth in claim 1, wherein:

(a) said open loop has an inside diameter on the same order of magnitude as the thickness of the tethering ring.

7. A tie-down bracket as set forth in claim 1, wherein:

(a) the pitch of the single coil of the helix is greater than the thickness of the tethering ring.

8. A tie-down bracket as set forth in claim 1, and further including:

(a) an automobile body wall, (b) a plastic wall liner extending along the surface of said body wall, and (c) fastening devices passing through the openings of the base member and through said body wall and wall liner, securing the base member to the wall with the liner sandwiched between, (d) said liner comprising the supporting surface which holds the tethering ring captive in the base member.

9. A tie-down bracket as set forth in claim 1, wherein:

(a) the base member has straight portions lying in substantially parallel planes.

10. A tie-down bracket as set forth in claim 1, wherein:

(a) the base member has straight portions on opposite sides of the helix, and which are substantially normal to the axis of the said helix.

11. A tie-down bracket as set forth in claim 9, wherein:

(a) the ends of the base member that form the openings, and the straight portions of the base member are substantially coplaner.

* * * * *